US010467944B2

(12) United States Patent
Guo et al.

(10) Patent No.: US 10,467,944 B2
(45) Date of Patent: Nov. 5, 2019

(54) METHOD FOR RENDERING PIXEL, APPARATUS FOR RENDERING PIXEL, AND DISPLAY DEVICE

(71) Applicants: Shenzhen China Star Optoelectronics Technology Co., Ltd., Shenzhen (CN); Wuhan China Star Optoelectronics Technology Co., Ltd., Wuhan (CN)

(72) Inventors: Xingling Guo, Shenzhen (CN); Xiaoping Tan, Shenzhen (CN); Jinjie Zhou, Shenzhen (CN)

(73) Assignee: SHENZHEN CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 192 days.

(21) Appl. No.: 14/907,913

(22) PCT Filed: Dec. 21, 2015

(86) PCT No.: PCT/CN2015/097992
§ 371 (c)(1),
(2) Date: Oct. 3, 2017

(87) PCT Pub. No.: WO2017/045286
PCT Pub. Date: Mar. 23, 2017

(65) Prior Publication Data

US 2018/0158394 A1 Jun. 7, 2018

(30) Foreign Application Priority Data

Sep. 18, 2015 (CN) ..... 2015 1 0601051

(51) Int. Cl.
*G09G 3/20* (2006.01)

(52) U.S. Cl.
CPC ..... *G09G 3/2074* (2013.01); *G09G 3/2003* (2013.01); *G09G 2310/027* (2013.01);
(Continued)

(58) Field of Classification Search
None
See application file for complete search history.

(56) References Cited

U.S. PATENT DOCUMENTS 6,198,467 B1 3/2001 Chiang
2004/0234163 A1* 11/2004 Lee ..... G06T 3/4092 382/298
(Continued)

FOREIGN PATENT DOCUMENTS

CN 103093722 A 5/2013
CN 103456280 A 12/2013
(Continued)

OTHER PUBLICATIONS

Office Action dated May 27, 2017 by the State Intellectual Property Office of the People's Republic of China in corresponding Chinese Patent Application No. 201510601051.4. (6 pages).
(Continued)

*Primary Examiner* — Christopher J Kohlman

(57) ABSTRACT

A method for rendering pixel, an apparatus for rendering pixel, and a display device are disclosed. The method includes steps of obtaining gray-scale values of three primary colors of an original image pixel in an RGB color space, converting the gray-scale values of three primary colors of the original image pixel into gray-scale values of three primary colors and a compensating component of a compensating image pixel, sampling from a compensating image, and setting the gray-scale values of the three primary colors and the compensating component of two adjacent
(Continued)

compensating image pixels in each row as gray-scale values of corresponding sub pixels of a screen pixel in each row.

20 Claims, 7 Drawing Sheets

(52) U.S. Cl.
CPC ..... *G09G 2310/0297* (2013.01); *G09G 2320/0242* (2013.01); *G09G 2330/021* (2013.01); *G09G 2340/0457* (2013.01)

(56) References Cited

U.S. PATENT DOCUMENTS

2013/0120472 A1* 5/2013 Byun ..... G09G 5/02 345/690
2014/0184655 A1* 7/2014 Jang ..... G09G 3/3208 345/690
2015/0339966 A1* 11/2015 Harada ..... G06T 1/20 345/605
2017/0053578 A1 2/2017 Chen et al.

FOREIGN PATENT DOCUMENTS

CN 104680992 A 6/2015
JP 3961706 B2 8/2007

OTHER PUBLICATIONS

Notification of Transmittal of the International Search Report and the Written Opinion of the International Searching Authority (Forms PCT/ISA/210, PCT/ISA/220, and PCT/ISA/237) dated Jun. 22, 2016, by the State Intellectual Property Office of People's Republic of China Patent Office in corresponding International Application No. PCT/CN2015/097995. (13 pages).

* cited by examiner

METHOD FOR RENDERING PIXEL, APPARATUS FOR RENDERING PIXEL, AND DISPLAY DEVICE

CROSS REFERENCE TO RELATED APPLICATIONS

The present application claims the priority of Chinese patent application CN201510601051.4, entitled "Method for Rendering Pixel, Apparatus for Rendering Pixel, and Display Device" and filed on Sep. 18, 2015, the entirety of which is incorporated herein by reference.

FIELD OF THE INVENTION

The present disclosure relates to the technical field of display, and particularly to a method for rendering pixel, an apparatus for rendering pixel, and a display device.

BACKGROUND OF THE INVENTION

A digital image generally comprises several image pixels, and each image pixel has limited discrete color values. For example, these color values are gray-scale values of red component, green component, and blue component in an RGB (Red-Green-Blue) color space. A plurality of screen pixels that are arranged in an array on a display device are driven according to the digital image, whereby the digital image can be displayed on the display device.

According to traditional sub pixel driving method, one sub pixel is used for displaying a gray-scale value of one color component of the image pixel. In order to improve a resolution of the display device, more image pixels need to be displayed. That is, a quantity of the sub pixels of a display screen should be increased. However, due to restriction of the manufacturing technology, the quantity of the sub pixels of the display screen can hardly be further increased when the quantity of the sub pixels is increased to a certain extent. As a result, the resolution of the display device can hardly be improved further.

Therefore, according to traditional technology, the digital image with a high resolution needs to be displayed on a display panel with a low resolution, and a spatial resolution and a definition of the digital image displayed therein should be ensured at the same time. In order to display the digital image with a high resolution on the display panel with a low resolution, a sub pixel rendering method as shown in FIG. 1 can be used. According to the sub pixel rendering method, three image pixels are compressed into one screen pixel.

According to the example as shown in FIG. 1, a red sub pixel R, a green sub pixel G, and a blue sub pixel B constitute one screen pixel C or D, and three image pixels are displayed by one screen pixel. With respect to six image pixels M−1, M, M+1, N−1, N, and N+1 that are arranged in sequence in a horizontal direction, the screen pixel C corresponds to image pixels M−1, M, and M+1, and the screen pixel D corresponds to image pixels N−1, N, and N+1. During sub pixel rendering procedure, gray-scale values of a red component of M−1, a green component of M, and a blue component of M+1 are respectively loaded on a red sub pixel, a green sub pixel, and a blue sub pixel of the screen pixel C. Similarly, gray-scale values of a red component of N−1, a green component of N, and a blue component of N+1 are respectively loaded on a red sub pixel, a green sub pixel, and a blue sub pixel of the screen pixel D. In this manner, three image pixels can be displayed by one screen pixel, whereby an apparent resolution of the display device can be improved. However, since a color of the digital image in a contour region or a small region with white color thereof changes rapidly, a serious "colored edge" phenomenon would occur when the image is processed by the sub pixel rendering method.

Therefore, a sub pixel multiplexing method whereby a high resolution of the display device can be ensured, and the "colored edge" phenomenon can be eliminated is needed.

SUMMARY OF THE INVENTION

The present disclosure aims to eliminate a "colored edge" phenomenon in sub pixel rendering technology and a color distortion resulted therefrom.

The present disclosure provides a method for rendering pixel, which comprises following steps:

obtaining gray-scale values of three primary colors of an original image pixel in an RGB color space;

converting the gray-scale values of three primary colors of the original image pixel into gray-scale values of three primary colors and a compensating component of a compensating image pixel;

sampling from a compensating image, in such a manner as to extract the gray-scale values of the three primary colors and the compensating component of two adjacent compensating image pixels in each row alternately; and setting the gray-scale values of the three primary colors and the compensating component of two adjacent compensating image pixels in each row as gray-scale values of corresponding sub pixels of a screen pixel in each row.

According to one embodiment, the compensating component is a white component, a yellow component, a cyan component, or a magenta component.

According to one embodiment, a row resolution of an original image is twice a row resolution of a display panel.

According to one embodiment, the step of converting the gray-scale values of three primary colors of the original image pixel into gray-scale values of three primary colors and a compensating component of a compensating image pixel comprises following sub steps:

determining the gray-scale value of the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the gray-scale value of the compensating component.

The present disclosure further provides an apparatus for rendering pixel, comprising:

an extracting unit, configured to obtain gray-scale values of three primary colors of an original image pixel in an RGB color space;

a converting unit, configured to convert the gray-scale values of three primary colors of the original image pixel into gray-scale values of three primary colors and a compensating component of a compensating image pixel;

a sampling unit, configured to sample from a compensating image, in such a manner as to extract the gray-scale values of three primary colors and the compensating component of two adjacent compensating image pixels in each row alternately; and a multiplexing unit, configured to set the gray-scale values of the three primary colors and the compensating component of two adjacent compensating image pixels in each row as gray-scale values of corresponding sub pixels of a screen pixel in each row.

According to one embodiment, the compensating component is a white component, a yellow component, a cyan component, or a magenta component.

According to one embodiment, a row resolution of an original image is twice a row resolution of a display panel.

According to one embodiment, the converting unit is specifically used for:

determining the gray-scale value of the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the gray-scale value of the compensating component.

The present disclosure further provides a display device, which comprises:

a display panel, which is provided with a plurality rows of screen pixels, each screen pixel comprising three primary color sub pixels and a compensating sub pixel, and the three primary color sub pixels and the compensating sub pixel being arranged in each row of screen pixels in an alternate manner;

an apparatus for rendering pixel as aforesaid;

a scanning driving circuit, configured to drive screen pixels in each of the rows in a circular manner; and a data driving circuit, configured to receive a gray-scale value of each sub pixel in each row of screen pixels from the apparatus for rendering pixel and providing the gray-scale value to a corresponding sub pixel of the screen pixels.

According to one embodiment, a compensating sub pixel of a screen pixel has a white color, a yellow color, a cyan color, or a magenta color.

According to the present disclosure, during a sampling procedure of the compensating image, three primary colors of one pixel are extracted from part of original image pixels, and thus the gray-scale values of three primary colors of the pixel are not changed. During the following multiplexing procedure, the gray-scale values of three primary colors of the original image pixel are loaded on one screen pixel, whereby a color error can be avoided, and the "colored edge" phenomenon can be eliminated. Moreover, the compensating component that is loaded on the screen pixel can compensate the brightness reduction resulted from abandoned original image pixels, so that the brightness of the screen image can be ensured after the rendering procedure.

Other features and advantages of the present disclosure will be further explained in the following description, and partially become self-evident therefrom, or be understood through the embodiments of the present disclosure. The objectives and advantages of the present disclosure will be achieved through the structure specifically pointed out in the description, claims, and the accompanying drawings.

BRIEF DESCRIPTION OF THE DRAWINGS

The accompanying drawings provide further understandings of the present disclosure and constitute one part of the description. The drawings are used for interpreting the present disclosure together with the embodiments, not for limiting the present disclosure. In the drawings.

DETAILED DESCRIPTION OF THE EMBODIMENTS

The present disclosure will be illustrated in detail hereinafter in combination with the accompanying drawings to enable the purpose, technical solutions, and advantages of the present disclosure more clear.

The embodiment of the present disclosure will be explained in detail hereinafter with reference to the accompanying drawings. It can be understood that, the preferred embodiments described herein are only used for explaining and illustrating, rather than restricting, the present disclosure. The technical features in the embodiments can be combined together in any manner, as long as there is no conflict.

In a region of a digital image with a rapid color change, a "colored edge" phenomenon would occur when the image is processed by a traditional sub pixel rendering method, and a principle thereof will be illustrated below.

Figure 1:
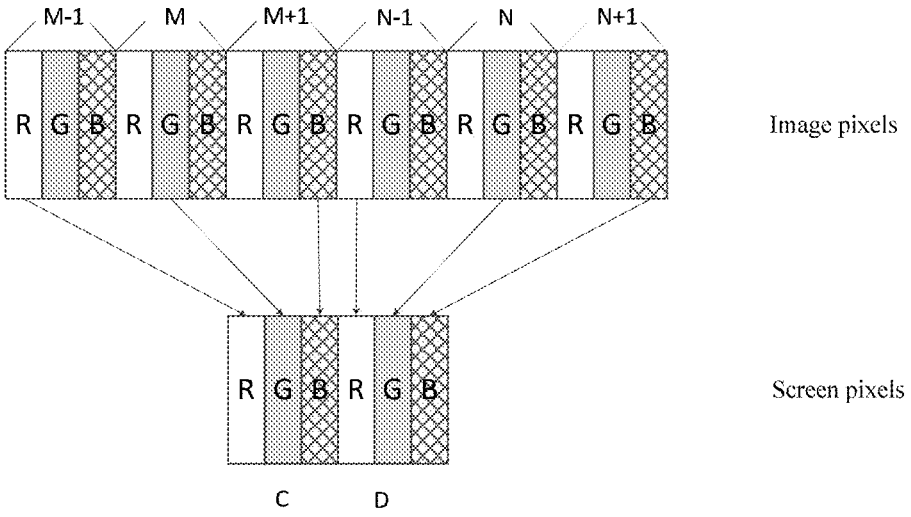
Fig. 1 Prior Art
FIG. 1 is a work principle of a sub pixel rendering method in the prior art.
Figure 2A:
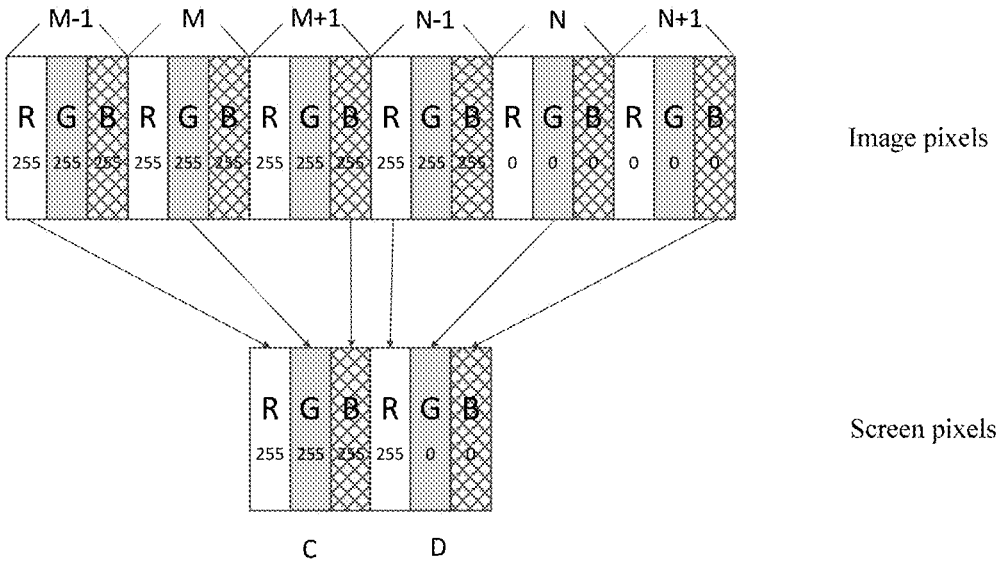
Fig. 2a Prior Art
FIGS. 2*a* and 2*b* show the "colored edge" phenomenon after a sub pixel rendering procedure in the prior art.

As shown in FIG. 2*a*, in a black-white edge of the digital image, image pixels M−1, M, M+1, and N−1 are all white pixels, wherein a gray-scale value of a red component, a gray-scale value of a green component, and a gray-scale value of a blue component thereof are all 255; and image pixels N and N+1 are both black pixels, wherein a gray-scale value of a red component, a gray-scale value of a green component, and a gray-scale value of a blue component thereof are all 0. During sub pixel rendering procedure, a red sub pixel, a green sub pixel, and a blue sub pixel of a screen pixel C are all loaded with the gray-scale value 255. That is, the screen pixel C has a white color after mixture of three primary colors. A red sub pixel of a screen pixel D is loaded with the gray-scale value 255, while a green sub pixel and a blue sub pixel thereof are both loaded with the gray-scale value 0. That is, the screen pixel D has a red color. An edge of an original digital image can be displayed, but a color error occurs.

Figure 2B:
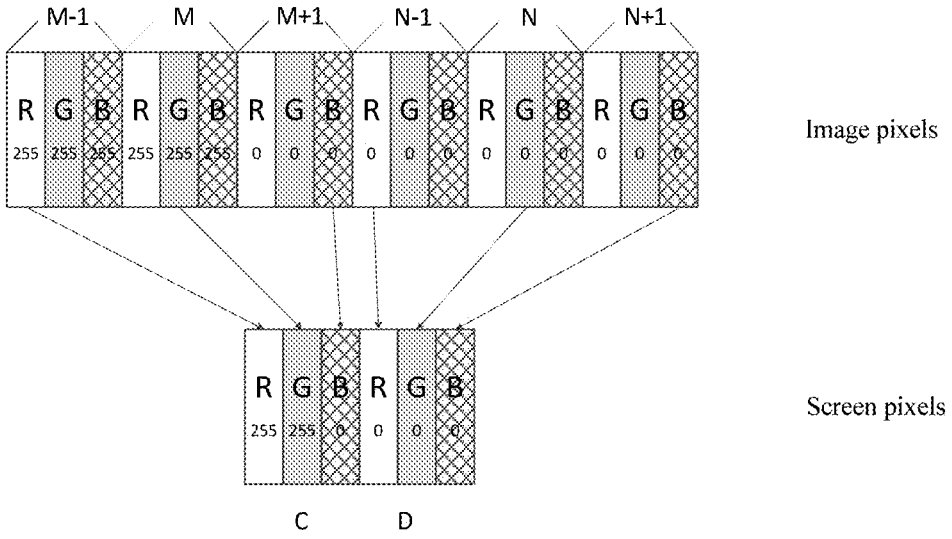
Fig. 2b Prior Art

As shown in FIG. 2*b*, image pixels M−1 and M are both white pixels, and image pixels M+1, N−1, N, and N+1 are all black pixels. After the sub pixel rendering procedure, a red sub pixel and a green sub pixel of a screen pixel C are both loaded with the gray-scale value 255, and a blue sub pixel thereof is loaded with the gray-scale value 0. The screen pixel C has a yellow color after mixture of red color and green color. A red sub pixel, a green sub pixel, and a blue sub pixel of a screen pixel D are all loaded with the gray-scale value 0, and thus the screen pixel D has a black color. As a result, a color error also occurs after the sub pixel rendering procedure, and the color displayed in FIG. 2*b* is different from the color displayed in FIG. 2*a*.

Based on the above analysis, it can be seen that, during the traditional sub pixel rendering procedure, a color error would occur due to the sampling method and multiplexing method thereof.

Embodiment 1

Figure 3:
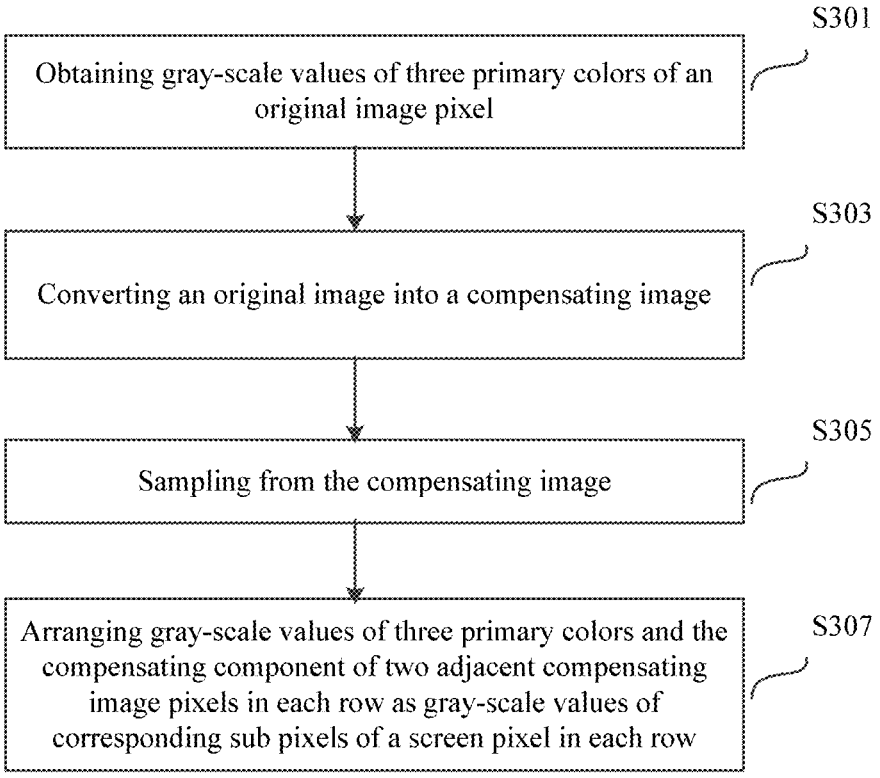
FIG. 3 is a flow chart of a pixel rendering method according to embodiment 1 of the present disclosure.
Figure 4:
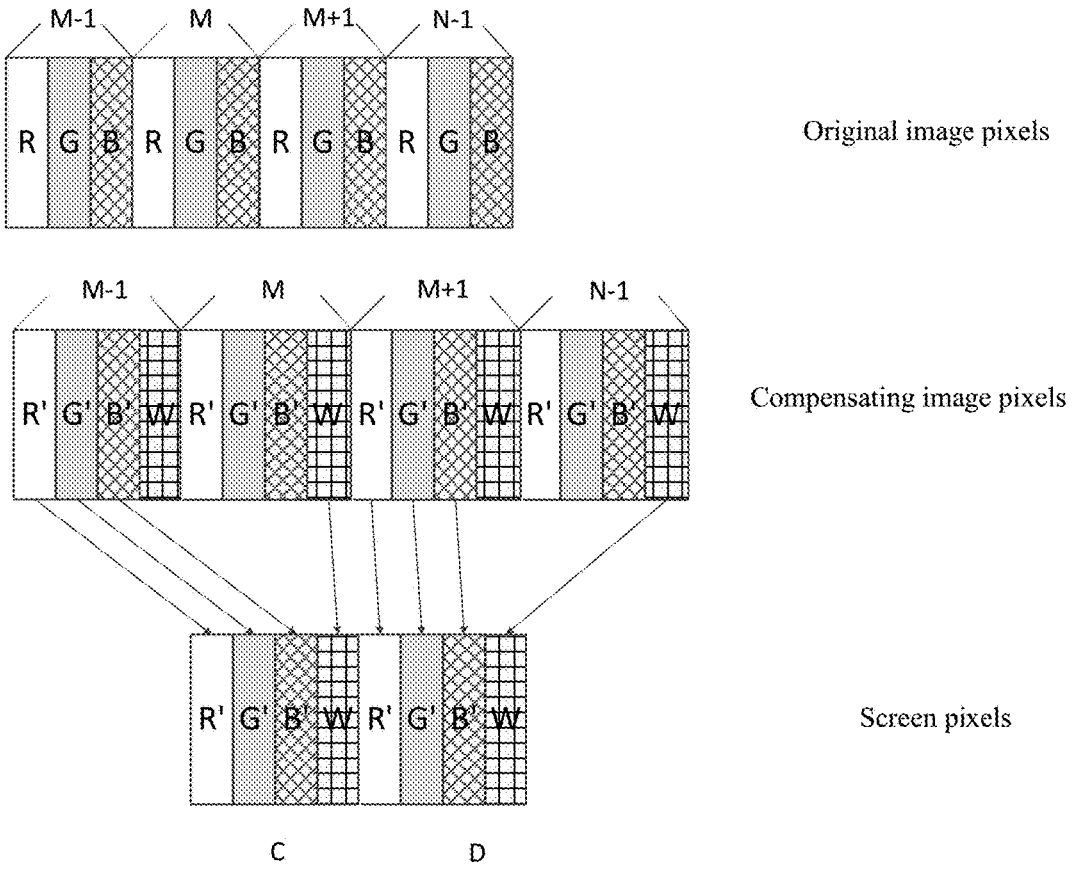
FIG. 4 shows a work principle of pixel sampling and multiplexing according to embodiment 1 of the present disclosure.

The present embodiment provides a method for rendering pixel, whereby pixels in one row of an original image with a high resolution can be sampled and multiplexed and the original image can be compressed so as to adapt to a physical resolution of a display screen. FIG. 3 is a flow chart of the pixel rendering method according to the present embodiment. FIG. 4 shows a work principle of pixel sampling and multiplexing according to the present embodiment.

First, in step S301, an original image with a high resolution is provided, and gray-scale values of three primary colors of an original image pixel in an RGB color space are obtained. That is, a gray-scale value of red component (R), a gray-scale value of green component (G), and a gray-scale value of blue component (B) are obtained. FIG. 4 schematically shows four original image pixels M−1, M, M+1, and N−1 that are arranged adjacent to one another in each row of the original image, and each pixel is represented by gray-scale values (R, G, B) of three primary colors.

Next, in step S303, the original image is converted into a compensating image. Specifically, a compensating component is added to each pixel of the original image. That is, the gray-scale values (R, G, B) of three primary colors of the original image pixel are converted into gray-scale values (R', G', B') of three primary colors and a gray-scale value of a compensating component W of a compensating image pixel. In general, a display screen based on mixture of light of three primary colors has a low light transmittance and a low light mixing efficiency, and thus the image actually displayed on the screen has a relatively low brightness. In this step, the compensating component is added, and thus the brightness of the display screen can be improved. The compensating component can be a white component, a yellow component, a cyan component, or a magenta component.

Under present technology, the compensating component is generally arranged to be a white component, and thus the RGB data of the original image are converted into RGBW data of the compensating image. In general, a minimum value Min(R, G, B) of the gray-scale values of three primary colors of the original image pixel is arranged to be the gray-scale value of the compensating component. Each component of the compensating image can be expressed as:

$$R'=R$$

$$G'=G$$

$$B'=B$$

$$W=\mathrm{Min}(R,G,B)$$

The three primary colors of the image actually displayed therein can all be added by the white component, and the brightness of the image can be improved, but the display panel would have an over high power consumption.

A calculation procedure of each component of the compensating image according to the present embodiment will be illustrated below taking the white component serving as the compensating component as an example.

A maximum value of the gray-scale values of three primary colors of the original image pixel is represented by Max(R,G,B), and a minimum value thereof is represented by Min(R,G,B). A saturation S of the original image pixel is expressed as:

$$S=[\mathrm{Max}(R,G,B)-\mathrm{Min}(R,G,B)]/\mathrm{Max}(R,G,B) \quad (1)$$

The gray-scale value of the compensating component is determined according to the saturation and the gray-scale values of three primary colors of the original image pixel. The compensating component of the compensating image pixel is expressed as:

$$W=\mathrm{Min}(R,G,B)*(1-S) \quad (2)$$

The gray-scale values of three primary colors of the compensating image pixel are then calculated. The gray-scale values of three primary colors of the compensating image pixel are expressed as:

$$R'=[\mathrm{Max}(R,G,B)+W]/\mathrm{Max}(R,G,B)*R-W$$

$$G'=[\mathrm{Max}(R,G,B)+W]/\mathrm{Max}(R,G,B)*G-W$$

$$B'=[\mathrm{Max}(R,G,B)+W]/\mathrm{Max}(R,G,B)*B-W \quad (3)$$

Taking the red component as an example:

$$\begin{aligned} R' &= \frac{\mathrm{Max}(R,G,B)+W}{\mathrm{Max}(R,G,B)}*R-W \\ &= R+\frac{W}{\mathrm{Max}(R,G,B)}*R-W \\ &= R+\frac{\mathrm{Min}(R,G,B)*(1-S)}{\mathrm{Max}(R,G,B)}*R-\mathrm{Min}(R,G,B)*(1-S) \\ &= R+\mathrm{Min}(R,G,B)*(1-S)*\frac{R}{\mathrm{Max}(R,G,B)}-\mathrm{Min}(R,G,B)* \\ &\quad (1-S) \\ &= R+\mathrm{Min}(R,G,B)*(1-S)*\left[\frac{R}{\mathrm{Max}(R,G,B)}-1\right] \end{aligned}$$

Since $$\frac{R}{\mathrm{Max}(R,G,B)}-1<0,$$

R'<R. Similarly, it can be obtained that, G'<G, and B'<B.

It can be seen that, compared with the traditional method for converting RGB data into RGBW data, according to the processing method of the present embodiment, the gray-scale value of the compensating component W and the gray-scale values (R', G', B') of three primary colors can all be reduced, and thus the power consumption of the display panel can be reduced. Moreover, the three primary colors of the image actually displayed therein can be increased by the white compensating component, so that brightness reduction resulted from the decreasing of the gray-scale values of three primary colors can be compensated, and the brightness of the display screen can be maintained unchanged.

As shown in FIG. 3, in step S305, the compensating image is sampled, i.e., the gray-scale values of three primary colors and the compensating component of two adjacent compensating image pixels in each row are extracted in an alternate manner. As shown in FIG. 4, the three primary colors (R', G', B') of the compensating image pixels M−1 and M+1 are extracted, and the compensating components W of the compensating image pixels M and N−1 are extracted.

Then, in step S307, the gray-scale values of three primary colors and the compensating component of two adjacent compensating image pixels in each row are arranged as gray-scale values of a corresponding sub pixel of a screen pixel in each row. The three primary colors (R', G', B') of the compensating image pixel M−1 and the compensating component W of the compensating image pixel M are multiplexed to a screen pixel C. That is, the gray-scale values of the three primary colors (R', G', B') of the compensating image pixel M−1 and the gray-scale value of the compensating component W of the compensating image pixel M are respectively loaded on the RGBW sub pixels of the screen pixel C. Similarly, the gray-scale values of the three primary colors (R', G', B') of the compensating image pixel M+1 and the gray-scale value of the compensating component W of the compensating image pixel N−1 are respectively loaded on the RGBW sub pixels of the screen pixel D, so that the display data of the screen pixels C and D as shown in FIG. 4 can be obtained.

According to the present embodiment, during a sampling procedure of the compensating image, three primary colors of one pixel are extracted from part of original image pixels, and thus the gray-scale values of three primary colors of the pixel are not changed. During the following multiplexing procedure, the gray-scale values of three primary colors of the original image pixel are loaded on one screen pixel, whereby a color error can be avoided, and the "colored edge" phenomenon can be eliminated.

Moreover, the compensating component that is loaded on the screen pixel can compensate the brightness reduction resulted from abandoned original image pixels, so that the brightness of the screen image can be ensured after the rendering procedure.

According to the present embodiment, a row resolution of an original image is twice a row resolution of a display panel. When the resolution of the original image does not match the resolution of the display panel, the screen image obtained through sampling and multiplexing procedures according to the image rendering method can improve a sensory resolution of eye.

Embodiment 2

Figure 5:
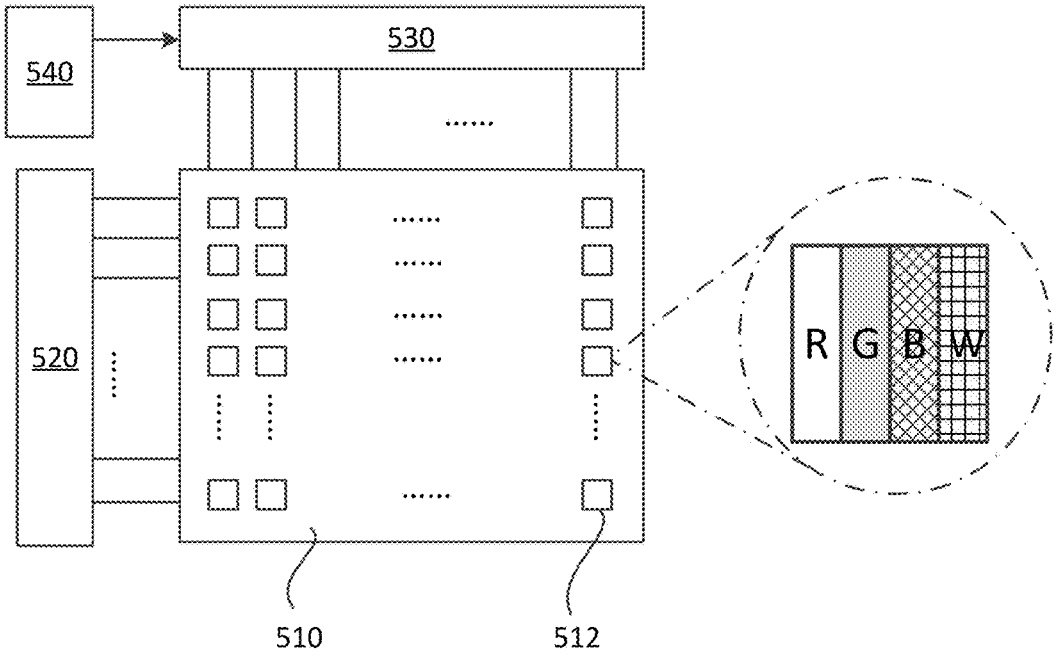
FIG. 5 schematically shows a structure of a display device according to embodiment 2 of the present disclosure.

The present embodiment provides a display device. As shown in FIG. 5, the display device comprises a display panel 510, a scanning driving circuit 520, a data driving circuit 530, and an apparatus for rendering pixel 540.

The display panel 510 is provided with a plurality rows of screen pixels 512. Each screen pixel 512 comprises three primary color sub pixels and a compensating sub pixel, and the three primary color sub pixels and the compensating sub pixel are arranged in each row of screen pixels in an alternate manner. The compensating sub pixel has a white color, a yellow color, a cyan color, or a magenta color.

The scanning driving circuit 520 and the data driving circuit 530 are respectively electrically connected with the display panel 510. The scanning driving circuit 520 is used for driving screen pixels in each row in a circular manner. The data driving circuit 530 is used for receiving a gray-scale value of each sub pixel in each row of screen pixels from the apparatus for rendering pixel and providing the gray-scale value to a corresponding sub pixel of the screen pixels, so that the rendered image can be displayed on the display panel 510.

Figure 6:
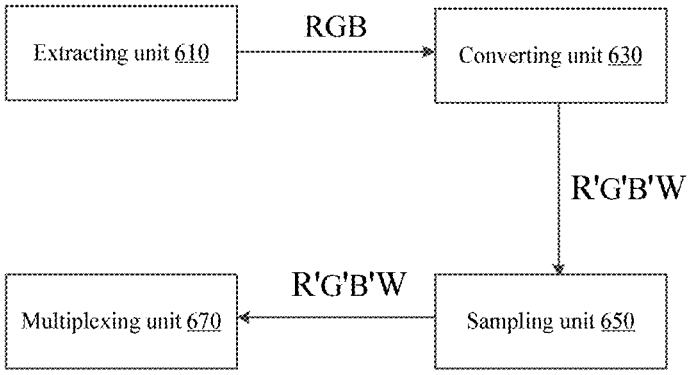
FIG. 6 schematically shows a structure of an apparatus for rendering pixel according to embodiment 2 of the present disclosure.

A structure of the apparatus for rendering pixel 540 is shown in FIG. 6. The apparatus for rendering pixel 540 comprises an extracting unit 610, a converting unit 630, a sampling unit 650, and a multiplexing unit 670.

The extracting unit 610 is used for obtaining gray-scale values (R, G, B) of three primary colors of an original image pixel in an RGB color space. The converting unit 630 is used for converting the gray-scale values (R, G, B) of three primary colors of the original image pixel into gray-scale values (R', G', B') of three primary colors and the gray-scale value of the compensating component W of the compensating image pixel. The sampling unit 650 is used for sampling from a compensating image, i.e., extracting gray-scale values (R', G', B') of three primary colors and the gray-scale value of the compensating component W of two adjacent compensating image pixels in each row in an alternate manner. The multiplexing unit 670 is used for arranging gray-scale values of three primary colors and the compensating component of two adjacent compensating image pixels in each row as gray-scale values of a corresponding sub pixel of a screen pixel in each row.

Specifically, the extracting unit 610, the converting unit 630, the sampling unit 650, and the multiplexing unit 670 respectively execute steps S301, S303, S305, and S307 of embodiment 1, whereby sampling and multiplexing can be performed on the original image with a high resolution, and the image data which is suitable for the display on a display panel with a low resolution can be obtained. During the image rendering procedure, a color error can be avoided. As a result, the "colored edge" phenomenon of the image displayed therein can be avoided after the rendering procedure.

When the pixel sampling and multiplexing method as shown in FIG. 4 is used, although the row resolution of the original image is twice the row resolution of the display panel, the resolution of the image sensed by eye is the same as the resolution of the original image, and thus the definition of the screen image can be improved.

According to the present embodiment, the display device can be a Liquid Crystal Display (LCD) device, an Organic Light-Emitting Diode (OLED) display device, and other flat display device.

The above embodiments are described only for better understanding, rather than restricting, the present disclosure. Any person skilled in the art can make amendments to the implementing forms or details without departing from the spirit and scope of the present disclosure. The protection scope of the present disclosure shall be determined by the scope as defined in the claims.

The invention claimed is:

1. A method for rendering pixel, comprising following steps:

obtaining gray-scale values (R, G, B) of three primary colors of an original image pixel in an RGB color space, wherein the gray-scale values (R, G, B) of three primary colors of a first original image pixel and a second original image pixel adjacent to the first original image pixel are obtained;

converting the gray-scale values (R, G, B) of three primary colors of the original image pixel into gray-scale values (R', G', B') of three primary colors and a compensating component W of a compensating image pixel, wherein the gray-scale values (R, G, B) of three primary colors of the first original image pixel is converted into the gray-scale values (R', G', B') of three primary colors and the compensating component W of a first compensating image pixel, and the gray-scale values (R, G, B) of three primary colors of the second original image pixel is converted into the gray-scale values (R', G', B') of three primary colors and the compensating component W of a second compensating image pixel adjacent to the first compensating image pixel;

sampling from a compensating image, in such a manner as to extract the gray-scale values (R', G', B') of the three primary colors and the compensating component W of two adjacent compensating image pixels in each row alternately, so that the gray-scale values (R', G', B') of the three primary colors of the first compensating image pixel is extracted, and the compensating component W of the second compensating image pixel is extracted; and setting the gray-scale values (R', G', B') of the three primary colors and the compensating component W of the two adjacent compensating image pixels in each row as gray-scale values of a corresponding sub pixel of a screen pixel in each row, wherein the gray-scale values (R', G', B') of the three primary colors of the first compensating image pixel are used as the gray-scale values of the corresponding sub pixel, and the compensating component W of the second compensating image pixel is used as the compensating component of the corresponding sub pixel.

2. The method according to claim 1, wherein the step of converting the gay-scale values (R, G, B) of three primary colors of the original image pixel into gray-scale values (R', G', B') of three primary colors and a compensating component W of a compensating image pixel comprises following sub steps:

determining the compensating component W according to a saturation S and a minimum value of the gay-scale values of three primary colors of the original image pixel, wherein a maximum value of the gay-scale values of three primary colors of the original image pixel is represented by Max(R,G,B), and the minimum value of the gray-scale values of three primary colors of the original image pixel is represented by Min(R,G,B), $$S=[\mathrm{Max}(R,G,B)-\mathrm{Min}(R,G,B)]/\mathrm{Max}(R,G,B)$$

$$W=\mathrm{Min}(R,G,B)*(1-S);\text{ and}$$

calculating the gray-scale values (R', G', B') of the three primary colors of the compensating image pixel according to the maximum value of the gray-scale values of three primary colors of the original image pixel and the the compensating component, wherein $$R'=[\mathrm{Max}(R,G,B)+W]/\mathrm{Max}(R,G,B)*R-W$$

$$G'=[\mathrm{Max}(R,G,B)+W]/\mathrm{Max}(R,G,B)*G-W$$

$$B'=[\mathrm{Max}(R,G,B)+W]/\mathrm{Max}(R,G,B)*B-W.$$

3. The method according to claim 1, wherein the compensating component W is a white component, a yellow component, a cyan component, or a magenta component.

4. The method according to claim 3, wherein the step of converting the gray-scale values (R, G, B) of three primary colors of the original image pixel into gray-scale values (R', G', B') of three primary colors and a compensating component W of a compensating image pixel comprises following sub steps:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

5. The method according to claim 1, wherein a row resolution of an original image is twice a row resolution of a display panel.

6. The method according to claim 5, wherein the step of converting the gray-scale values (R, G, B) of three primary colors of the original image pixel into gray-scale values (R', G', B') of three primary colors and a compensating component W of a compensating image pixel comprises following sub steps:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

7. An apparatus for rendering pixel, comprising:

an extracting unit, configured to obtain gray-scale values (R, G, B) of three primary colors of an original image pixel in an RGB color space, wherein the gray-scale values (R, G, B) of three primary colors of a first original image pixel and a second original image pixel adjacent to the first original image pixel are obtained;

a converting unit, configured to convert the gray-scale values (R, G, B) of three primary colors of the original image pixel into gray-scale values (R, G', B') of three primary colors and a compensating component W of a compensating image pixel, wherein the gray-scale values (R, G, B) of three primary colors of the first original image pixel is converted into the gray-scale values (R', G', B') of three primary colors and the compensating component W of a first compensating image pixel, and the gay-scale values (R, G, B) of three primary colors of the second original image pixel is converted into the gray-scale values (R', G', B") of three primary colors and the compensating component W of a second compensating image pixel adjacent to the first compensating image pixel;

a sampling unit, configured to sample from a compensating image, in such a manner as to extract the gay-scale values (R', G', B') of three primary colors and the compensating component W of two adjacent compensating image pixels in each row alternately, so that the gray-scale values (R', G', B') of the three primary colors of the first compensating image pixel is extracted, and the compensating component W of the second compensating image pixel is extracted; and a multiplexing unit, configured to set the gray-scale values (R', G', B') of the three primary colors and the compensating component W of the two adjacent compensating image pixels in each row as gray-scale values of a corresponding sub pixel of a screen pixel in each row, wherein the gray-scale values (R', G', B') of the three primary colors of the first compensating image pixel are used as the gray-scale values of the corresponding sub pixel, and the compensating component W of the second compensating image pixel is used as the compensating component of the corresponding sub pixel.

8. The apparatus according to claim 7, wherein the converting unit is specifically used for:

determining the compensating component W according to a saturation S and a minimum value of the gray-scale values of three primary colors of the original image pixel, wherein a maximum value of the gray-scale values of three primary colors of the original image pixel is represented by Max(R,G,B), and the minimum value of the gray-scale values of three primary colors of the original image pixel is represented by Min(R,G,B), $$S=[\mathrm{Max}(R,G,B)-\mathrm{Min}(R,G,B)]/\mathrm{Max}(R,G,B)$$

$$W=\mathrm{Min}(R,G,B)*(1-S);\text{ and}$$

calculating the gray-scale values (R', G', B') of the three primary colors of the compensating image pixel according to the maximum value of the gray-scale values of three primary colors of the original image pixel and the the compensating component, wherein $$R'=[\mathrm{Max}(R,G,B)+W]/\mathrm{Max}(R,G,B)*R-W$$

$$G'=[\mathrm{Max}(R,G,B)+W]/\mathrm{Max}(R,G,B)*G-W$$

$$B'=[\mathrm{Max}(R,G,B)+W]/\mathrm{Max}(R,G,B)*B-W.$$

9. The apparatus according to claim 7, wherein the compensating component W is a white component, a yellow component, a cyan component, or a magenta component.

10. The apparatus according to claim 9, wherein the converting unit is specifically used for:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

11. The apparatus according to claim 7, wherein a row resolution of an original image is twice a row resolution of a display panel.

12. The apparatus according to claim 11, wherein the converting unit is specifically used for:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

13. A display device, comprising:

a display panel, which is provided with a plurality rows of screen pixels, each screen pixel comprising three primary color sub pixels and a compensating sib pixel, and the three primary color sub pixels and the compensating sub pixel being arranged in each row of screen pixels in an alternate manner;

an apparatus for rendering pixel, which comprises:

an extracting unit, configured to obtain gray-scale values (R, G, B) of three primary colors of an original image pixel in an RGB color space, wherein the gray-scale values (R, G, B) of three primary colors of a first original image pixel and a second original image pixel adjacent to the first original image pixel are obtained;

a converting unit, configured to convert the gay-scale values (R, G, B) of three primary colors of the original image pixel into gay-scale values (R', G', B') of three primary colors and a compensating component W of a compensating image pixel, wherein the gray-scale values (R, G, B) of three primary colors of the first original image pixel is converted into the gray-scale values (R', G', B') of three primary colors and the compensating component W of a first compensating image pixel, and the gray-scale values (R, G, B) of three primary colors of the second original image pixel is converted into the gray-scale values (R', G', B') of three primary colors and the compensating component W of a second compensating image pixel adjacent to the first compensating image pixel;

a sampling unit, configured to sample from a compensating image, in such a manner as to extract the gray-scale values (R', G', B') of the three primary colors and the compensating component W of two adjacent compensating image pixels in each row alternately, so that the gray-scale values (R', G', B') of the three primary colors of the first compensating image pixel is extracted, and the compensating component W of the second compensating image pixel is extracted; and a multiplexing unit, configured to the gray-scale values (R', G', B') of the three primary colors and the compensating component W of the two adjacent compensating image pixels in each row as gray-scale values of a corresponding sub pixel of a screen pixel in each row, wherein the gray-scale values (R', G', B') of the three primary colors of the first compensating image pixel are used as the gray-scale values of the corresponding sub pixel, and the compensating component W of the second compensating image pixel is used as the compensating component of the corresponding sub pixel;

a scanning driving circuit, configured to drive screen pixels in each of the rows in a circular manner; and a data driving circuit, configured to receive a gray-scale value of each sub pixel in each row of screen pixels from the apparatus for rendering pixel and providing the gray-scale value to a corresponding sub pixel of the screen pixels.

14. The display device according to claim 13, wherein the converting unit is specifically used for:

determining the compensating component W according to a saturation S and a minimum value of the gray-scale values of three primary colors of the original image pixel, wherein a maximum value of the gray-scale values of three primary colors of the original image pixel is represented by Max(R,G,B), and the minimum value of the gray-scale values of three primary colors of the original image pixel is represented by Min(R,G,B), $$S=[\mathrm{Max}(R,G,B)-\mathrm{Min}(R,G,B)]/\mathrm{Max}(R,G,B)$$

$$W=\mathrm{Min}(R,G,B)*(1-S);\text{ and}$$

calculating the gray-scale values (R', G', B') of the three primary colors of the compensating image pixel according to the maximum value of the gray-scale values of three primary colors of the original image pixel and the the compensating component, wherein $$R'=[\mathrm{Max}(R,G,B)+W]/\mathrm{Max}(R,G,B)*R-W$$

$$G'=[\mathrm{Max}(R,G,B)+W]/\mathrm{Max}(R,G,B)*G-W$$

$$B'=[\mathrm{Max}(R,G,B)+W]/\mathrm{Max}(R,G,B)*B-W.$$

15. The display device according to claim 13, wherein the compensating component W is a white component, a yellow component, a cyan component, or a magenta component.

16. The display device according to claim 15, Wherein the converting unit is specifically used for:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

17. The display device according to claim 16, wherein a compensating sub pixel of a screen pixel has a white color, a yellow color, a cyan color, or a magenta color.

18. The display device according to claim 13, wherein a row resolution of an original image is twice a row resolution of a display panel.

19. The display device according to claim 18, wherein the converting unit is specifically used for:

determining the compensating component according to a saturation and a minimum value of the gray-scale values of three primary colors of the original image pixel; and calculating the gray-scale values of the three primary colors of the compensating image pixel according to a maximum value of the gray-scale values of three primary colors of the original image pixel and the compensating component.

20. The display device according to claim 19, wherein a compensating sub pixel of a screen pixel has a white color, a yellow color, a cyan color, or a magenta color.

* * * * *